US006952671B1

(12) United States Patent
Kolesnik et al.

(10) Patent No.: US 6,952,671 B1
(45) Date of Patent: Oct. 4, 2005

(54) VECTOR QUANTIZATION WITH A NON-STRUCTURED CODEBOOK FOR AUDIO COMPRESSION

(75) Inventors: Victor Kolesnik, St. Petersburg (RU); Boris Kudryashov, St. Petersburg (RU); Eugeny Ovsjannikov, St. Petersburg (RU); Sergey Petrov, St. Petersburg (RU); Boris Trojanovsky, St. Petersburg (RU)

(73) Assignee: XVD Corporation, Fremont, CA (US)

( * ) Notice: Subject to any disclaimer, the term of this patent is extended or adjusted under 35 U.S.C. 154(b) by 897 days.

(21) Appl. No.: 09/649,143

(22) Filed: Aug. 25, 2000

Related U.S. Application Data

(60) Provisional application No. 60/157,647, filed on Oct. 4, 1999.

(51) Int. Cl.[7] ..... G10L 19/00

(52) U.S. Cl. ..... 704/222

(58) Field of Search ..... 704/221–223

(56) References Cited

U.S. PATENT DOCUMENTS 5,598,505 A * 1/1997 Austin et al. ..... 704/222
5,765,127 A * 6/1998 Nishiguchi et al. ..... 704/221
5,774,839 A 6/1998 Shlomot
5,802,487 A 9/1998 Tanaka
6,041,297 A * 3/2000 Goldberg ..... 704/223

OTHER PUBLICATIONS

Gersho, Allen and Gray, Robert M., Vector Quantization and Signal Compression, 1992, Kluwer Academic Publishers, pp. 1 5, 358–361, 451–453, and 461–465.*

A.V. McRee and T.P. Barnwell. "A Mixed Excitation LPC Vocoder Model For Low Bit Rate Speech Coding", IEEE Transactions on speech and audio processing. vol. 3, No. 4, Jul. 1995, pp. 242–250.

J.Pan and T.R. Fischer, "Two–stage Vector Quantization—Lattice Vector Quantization", IEEE Trans. Inform. Theory, vol. IT–41, No. 1, pp. 155–163, Jan. 1995.

K.K. Paliwal and B.S. Atal. "Efficient Vector Quantization of LPC Parameters at 24 Bits/Frame", Proceedings of IEEE ICASSP, 1991, vol. 1, pp. 661–664.

B.H. Juang and A.H. Gray, Jr., "Multiple Stage Vector Quantization For Speech Coding", Proceedings of IEEE ICASSP, 1991, vol. 1, pp. 597–600.

W.P. LeBlanc, B. Bhatacharya, S.A. Mahmood and V. Coperman, "Efficient Search and Design Procedures for Robust Multistage VQ of LPC Parameters for 4kb/s Speech Coding" IEEE Transactions on speech and audio processing. vol. 1, No. 4, Oct. 1993, pp. 373–385.

Mei Yong, Grant Davidson, and Allen Gersho, "Encoding Of LPC Spectral Parameters Using Switched–Adaptive Interframe Vector Predication", IEEE. 1988, pp. 402–405.

Jose Antonio Martins and Fabio Violaro, "Low Bit Rate LPC Vocoders Using Vector Quantization and Interpolation", IEEE. 1991, pp. 597–600.

(Continued)

*Primary Examiner*—David D. Knepper
(74) *Attorney, Agent, or Firm*—Blakely, Sokoloff, Taylor & Zafman

(57) ABSTRACT

According to one embodiment of the invention, a multistage vector list quantizer comprises a first stage quantizer to select candidate first stage codewords from a plurality of first stage codewords, a reference table memory storing a set of second stage codewords for each first stage codeword, and a second stage codebook constructor to generate a reduced complexity second stage codebook that is the union of sets corresponding to the candidate first stage codewords selected by the first stage quantizer.

29 Claims, 8 Drawing Sheets

OTHER PUBLICATIONS

Houman Zarrinkoub and Paul Mermelstein, "Switched Predication and Quantization of LSP Frequencies", IEEE. 1995. pp. 757–759.

Kazunori Ozawa, Masahiro Serizawa, Toshiki Miyano and Toshiyuki Nomura, "M–LCELP Speech Coding at 4KBPS", Information Technology Research Labs, NEC Corporation. IEEE. 1994 pps. I–269–I–272.

Rajiv Laroia, Nam Phamdo, and Nariman Farvardin, "Robust and Efficient Quantization of Speech LSP Parameters Using Structured Vector Quantizers", Electrical Engineering Department, Institute for Advanced Computer Studies and Systems Research Center, University of Maryland. IEEE 1991. pp. 641–644.

Kazunori Ozawa and Toshiki Miyano. "4KB/S Improved Celp Coder With Efficient Vector Quantization". C&C Information Technology Research Labs. NEC Corporation. IEEE 1991. pp 213–216.

Akitoshi Kataoka, Takehiro Moriya and Shinji Hayashi. An 8–kbit/s Speech Coder Based on Conjugate Structure CELP. NTT Human Interface Laboratories. IEEE 1993. pp. II–592–II–595.

* cited by examiner

EXAMPLE OF BIT ALLOCATION FOR 16 BITS PER LSF VECTOR CODING, $N=3$, $M_1=256$, $M_2=M_3$, $M_4=128$.

A) IF FIRST PREDICTOR IS THE BEST:

B) IF 2D OR 3D PREDICTOR IS THE BEST:

VECTOR QUANTIZATION WITH A NON-STRUCTURED CODEBOOK FOR AUDIO COMPRESSION

CROSS-REFERENCE TO RELATED APPLICATIONS

This application claims the benefit of U.S. Provisional Patent Application No. 60/157,647, entitled "Method And Apparatus For A Linear Spectral Frequency Audio Compression," filed Oct. 4, 1999.

FIELD OF INVENTION

The invention relates to low rate speech coding in communication and data processing systems, and more particularly to spectrum quantization of voice signals.

BACKGROUND OF THE INVENTION

Digital speech processing is extensively used in communication systems, telephony, digital answering machines, low rate videoconferencing, etc. Low rate speech coding is typically based on parametric modeling of the speech signal. The speech encoder computes representative parameters of the speech signal, quantizes them into products, and places them into the data stream, which may be sent over a digital communication link or saved in a digital storage media. A decoder uses those speech parameters to produce the synthesized speech.

Almost all known speech compression algorithms for bit rates less than or equal to 8000 are based on linear prediction. Typically, linear prediction coefficients (LPC) are transmitted as linear spectral frequencies (LSF) (sometimes they are called "linear spectral parameters (LSP)" or "linear spectral pairs (LSP)"). Depending on the bit rate provided by the speech compression algorithm, LSF are updated once per 10–30 ms. Usually a 10th order linear prediction filter is used, which means that the LSF are represented by a 10-dimensional vector.

FIG. 1 is a block diagram of a typical LSF encoder based on vector quantization. The current frame of a digitized speech signal enters the LSF calculator unit 110 where the current LSF vector is computed. Previous quantized LSF vectors are kept in the buffer memory 150. Typically only one last previous vector is stored in the buffer memory 150. The LSF predictor unit 160 computes some predetermined number of LSF vector predicted values. Some of these predicted values are typically independent of previous LSF vectors.

Then the current LSF vector and the set of predicted LSF vectors enters the vector quantizer unit 120. The vector quantizer unit 120 determines the best codebook index (or set of indices) and the best predictor number to provide the best approximation of the current LSF vector in the sense of some distortion measure. All indices computed by the vector quantizer enter indices encoder unit 130 where they are transformed into the codeword corresponding to the current LSF vector.

This codeword is sent along with other speech parameters into a data link transmission medium or a digital memory. Also, the codebook indices and predictor index enter the LSF reconstruction unit 140. Another input of the reconstruction unit is the set of predicted LSF vectors. In the LSF reconstruction unit 140 the quantized LSF vector is reconstructed. This vector is then saved in the buffer unit 150 to be used for prediction next LSF vectors.

Early quantizers used a single non-structured code and compared the source vector to each entry in the codebook (referred to as "full search quantizers"). The performance of vector quantization depends on the size of the codebook used, and to obtain better results, larger codebooks have to be used. On the other hand, storage and processing complexities also increase with increasing codebook size. To overcome this problem, suboptimal vector quantization procedures have been proposed that use multiple structured codebooks. One of the most widely used procedures is multistage vector quantization (MSVQ). In MSVQ a sequence of vector quantizers (VQ) is used. The input of the next VQ is the quantization error vector of the previous VQ.

An improvement on MSVQ is M-best or delayed decision MSVQ, which is described in (W. P. LeBlanc, B. Bhatacharya, S. A. Mahmood and V. Cuperman, "Efficient search and design procedures for robust multistage VQ of LPC Parameters for 4 kb/s speech coding" *IEEE Transactions on speech and audio processing*. Vol. 1, No. 4, Oct. 1993, pp. 373–385). The M-best MSVQ achieves better quantization results by keeping from stage to stage a few candidates (M candidates). The final decision for each stage is made only when the last quantization stage is performed. The more candidates that are kept, the higher the quantization gain that may be achieved and the greater the computational complexity.

The unit having the greatest impact on the performance of the quantizer is the vector quantization unit. Typically, an LSF vector is split into subvectors (usually 1 to 3 subvectors). A vector quantization procedure is then applied to each subvector. To improve the quantization accuracy, it is necessary to increase the dimensions of the subvectors and the corresponding codebook sizes. However, this leads to increasing the computational load needed for full search quantization. To decrease computational complexity, a multistage M-best quantization procedure is used.

The block diagram of a two-stage M-best quantizer is shown in FIG. 2. A source vector enters the first quantizer 210 having a smaller structured codebook $C_1$ of size $L_1$. For each entry x of the set of $L_1$ codewords, the residual, or error vector is computed by subtracting x from the source vector. The output of this quantizer is a set of $M_1$ codewords closest to the source vector in the sense of some distortion measure. The error vectors are processed by the second quantizer 220 with a smaller structured codebook $C_2$ of size $L_2$. The resulting candidate code vector(s) are then obtained as component wise sums of the first quantizer output and the corresponding approximated errors by adder 230. The final decision is made by the select best codeword unit 240 which selects from among the candidates the candidate closest to the source vector.

The common property of these suboptimal vector quantizers is that they reduce computational complexity by replacing an optimal large size non-structured codebook with a direct sum of small structured codebooks.

SUMMARY OF THE INVENTION

A reduced complexity vector quantizer is described. According to one embodiment of the invention, a multistage vector list quantizer comprises a first stage quantizer to select candidate first stage codewords from a plurality of first stage codewords, a reference table memory storing a set of second stage codewords for each first stage codeword, and a second stage codebook constructor to generate a reduced complexity second stage codebook that is the union of sets corresponding to the candidate first stage codewords selected by the first stage quantizer.

BRIEF DESCRIPTION OF THE DRAWINGS

The present invention is illustrated by way of example and not limitation in the figures of the accompanying drawings, in which like references indicate similar elements, and in which.

DETAILED DESCRIPTION

In the following description, numerous specific details are set forth to provide a thorough understanding of the invention. However, it is understood that the invention may be practiced without these specific details. In other instances, well-known structures and techniques have not been shown in detail in order not to obscure the invention.

Figure 4:
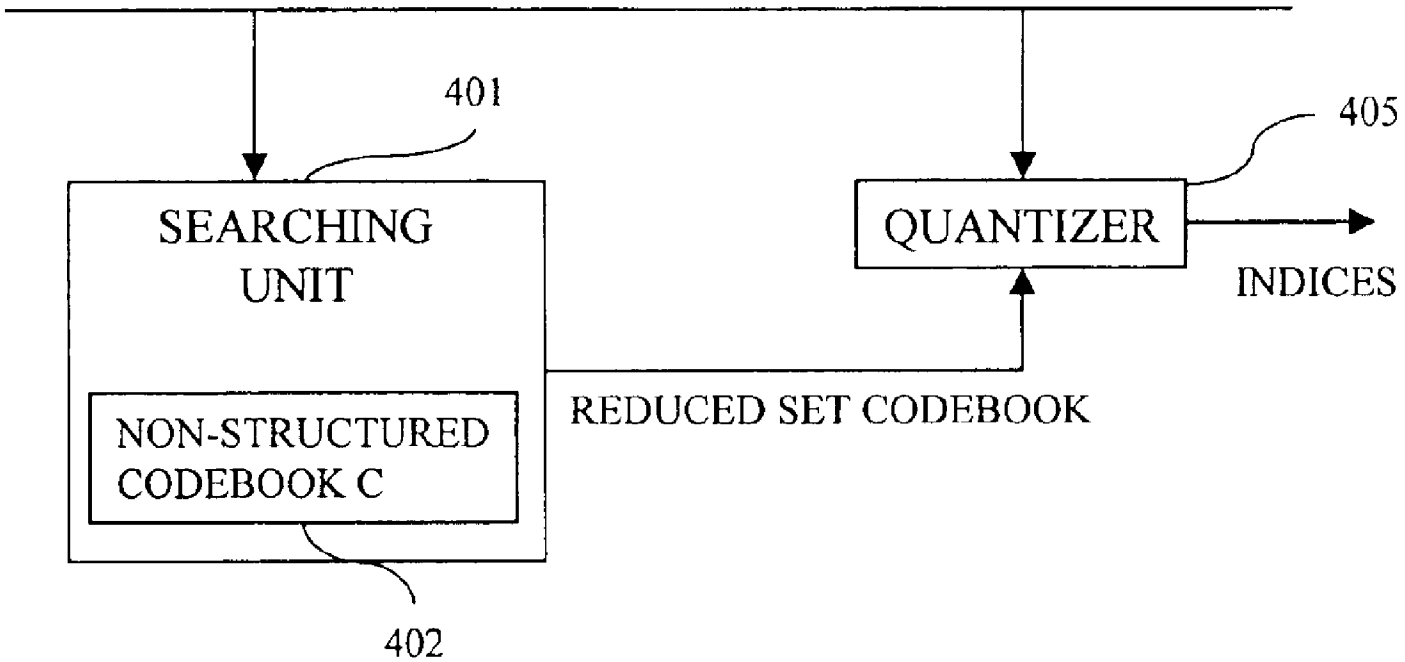
FIG. 4 is a block diagram illustrating a reduced complexity quantizer that uses a non-structured codebook according to one embodiment of the invention.

FIG. 4 is a block diagram illustrating a reduced complexity quantizer that uses a non-structured codebook according to one embodiment of the invention. FIG. 4 shows a searching unit 401 and a quantizer 405. The searching unit 401 includes a non-structured codebook C 402. Both the searching unit 401 and the quantizer 405 received the same source vector. The searching unit 401 uses a technique to dynamically select a subset of the codewords from the non-structured codebook C to form a reduced complexity codebook based on the current source vector. This reduced complexity codebook is provided to the quantizer 405.

The technique used by the searching unit 401 to select codewords from the non-structured code book C 402 to dynamically form the reduced complexity code book from the current input source vector depends on the implementation. However, the technique used will operate by performing less than a comparison of the source vector to every codeword in the codebook C. In particular, assume the codebook C includes L codewords. The searching unit will identify a subset of the L codewords without comparing the current source vector to each of the L codewords. The reduced complexity codebook is then used by the quantizer 405 to quantize the source vector. As such, the source vector is quantized with a subset of the codewords from the original non-structured codebook C, rather than a direct sum of small structured codebooks as used in MSVQ techniques. In addition, the system of FIG. 4 uses a non-structured codebook, without performing all the comparisons required by the prior art full search quantizer. While various techniques can be used to implement the searching unit, several such embodiments are described herein with reference to FIGS. 3 and 5–7.

Figure 1:
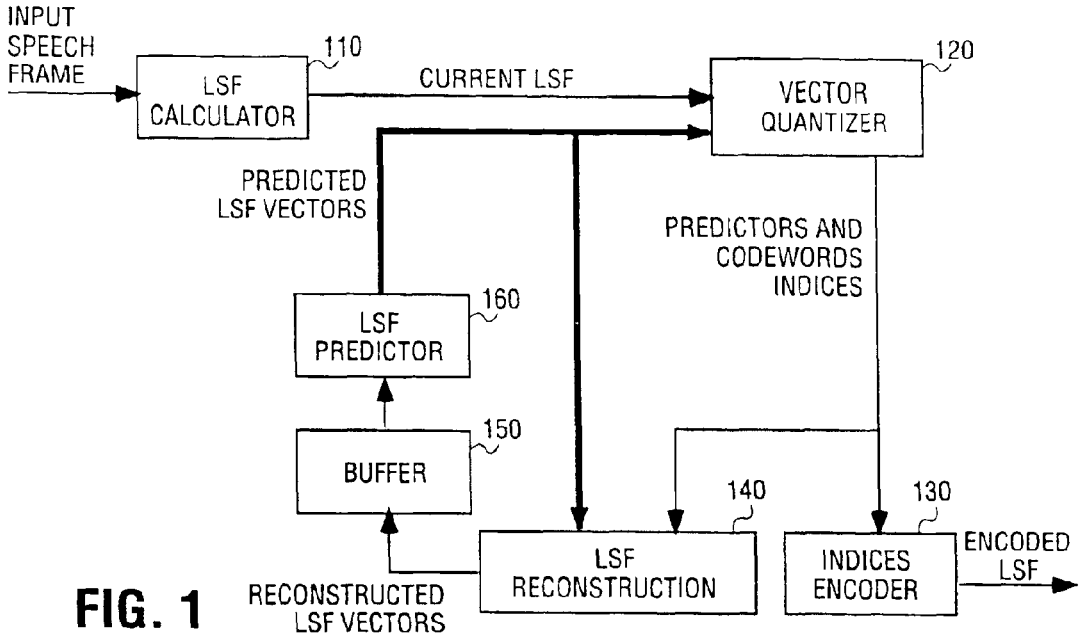
FIG. 1 (PRIOR ART)
FIG. 1 (prior art) is a block diagram illustrating a general structure of an LSF encoder based on vector quantization.
Figure 2:
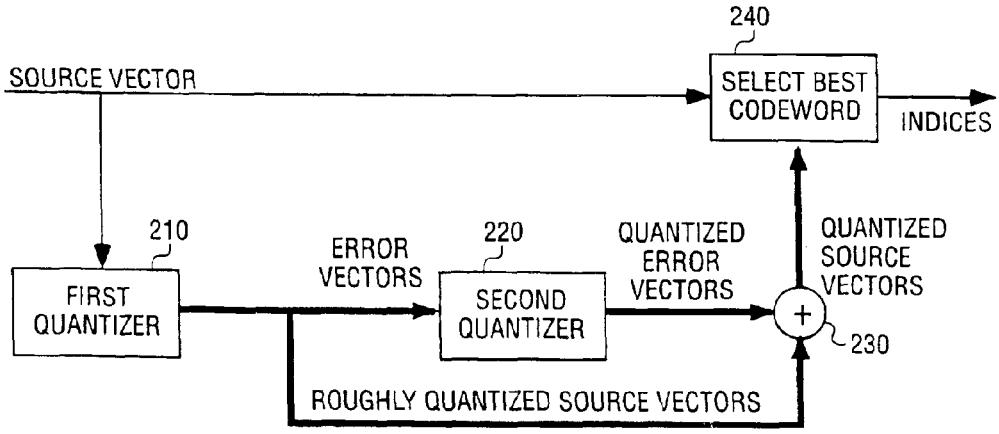
FIG. 2 (PRIOR ART)
FIG. 2 (prior art) is a block diagram illustrating a general structure for two-stage M-best vector quantization.
Figure 3:
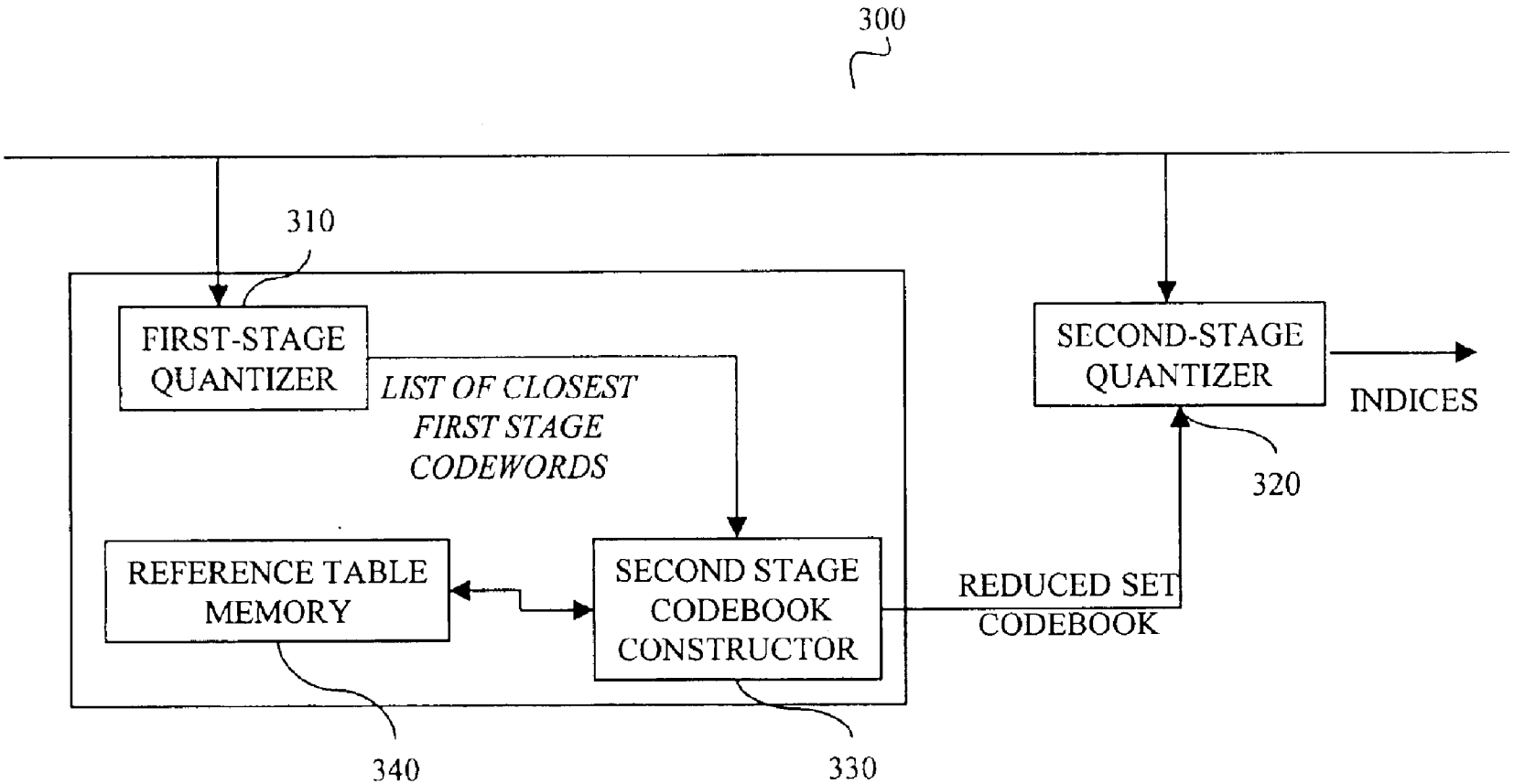
FIG. 3 is a block diagram of a two-stage list quantizer according to one embodiment of the invention.

FIG. 3 is a block diagram of a two-stage list quantizer according to one embodiment of the invention. The advantage of this quantizer over prior art suboptimal quantizers is that the computational complexity is reduced without a loss of quantization accuracy. Let C be a codebook with L k-dimensional vectors, generated, for example, by a well-known procedure, such as an LBG algorithm. The Multi-stage List Quantizer (MSLQ) 300 starts with a "coarse" pre-quantization of the source vector in the first-stage quantizer 310. First-stage quantizer 310 has a first stage codebook $C_1$ containing $L_1$ first stage codewords labeled $x_1$ to $x_{L_1}$. Its output is the first stage list of indices of $M_1$ codewords $(j_1, \ldots, j_{M_1})$ closest to the source vector.

This list enters second-stage reduced complexity codebook constructor 330. The second-stage reduced complexity codebook constructor 330 is coupled to reference table memory unit 340. For each index of a codeword from first stage codebook $C_1$, the reference table memory unit 340 keeps a precomputed set of P indices of second stage codewords from C. The second stage codebook $C_2$ is dynamically constructed by selecting codewords from C based on this table. In particular, let $C_2(j)$ denote the subset of C corresponding to the $x_{i^{th}}$ codeword from $C_1$. The second-stage reduced complexity codebook construction unit creates the second stage reduced complexity codebook as a union of the subsets $C_2(j)$, where $j=1, \ldots, M_1$; reduced complexity codebook $C_2$ having $L_2$ codewords comprising=

$$\bigcup_{i=1}^{M_1} C_2(j_i).$$

The second stage reduced complexity codebook enters second-stage quantizer 320. The second-stage quantizer selects the best (closest to source vector) codeword from among the codewords of the reduced complexity codebook. This index of the codeword is the output of quantizer 300.

Thus, the searching unit of FIG. 3 uses a codebook C with L k-dimensional vectors, generated, for example, by a well known procedure, such as an LBG algorithm. The first-stage quantizer 310 uses a smaller codebook $C_1$ with $L_1$ codewords (where $L_1<L$) based on C to quantize the source vector. The reduced codebook constructor 330 uses the codewords or indices of codewords selected by the first stage quantizer 310 to identify sets of P codewords, where $L/L_1<P$, from the reference table 340. The reduced codebook constructor combines the identified sets to create the reduced codebook $C_2$ having $L_2$ codewords from C.

Figure 5A:
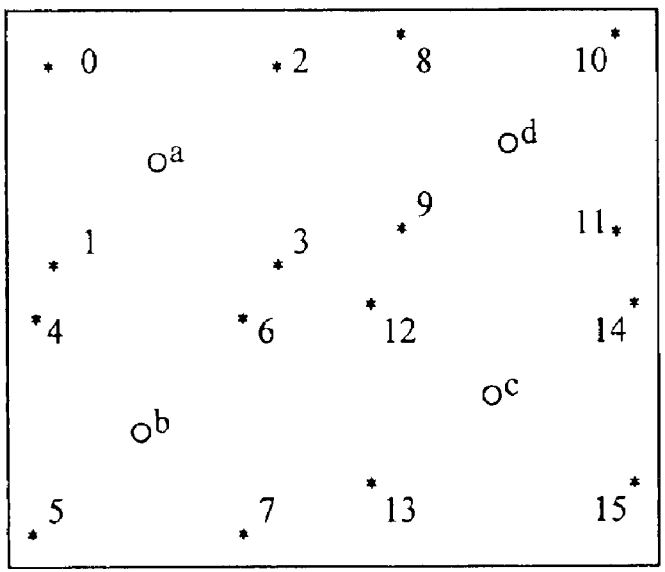
Fig. 5A (PRIOR ART)
FIG. 5A (prior art) illustrates the result of the combined first and second structured codebooks of a two-stage vector quantizer.
Figure 5B:
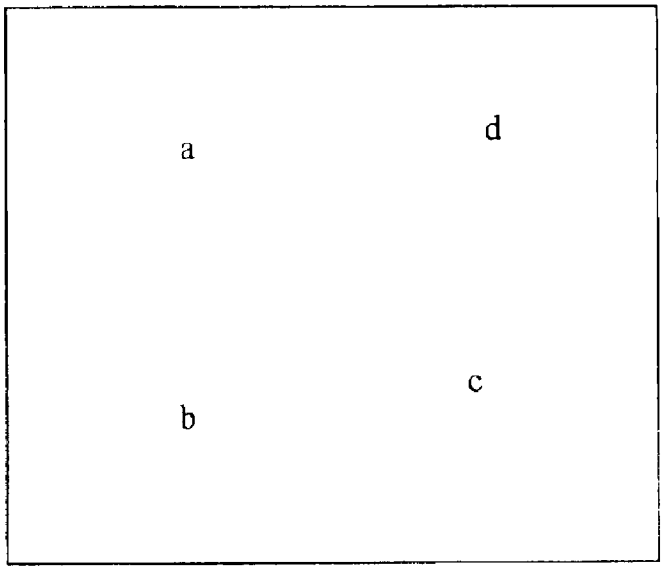
Fig. 5B (PRIOR ART)
FIG. 5B (prior art) shows the 4 codewords of the first stage codebook.
Figure 5C:
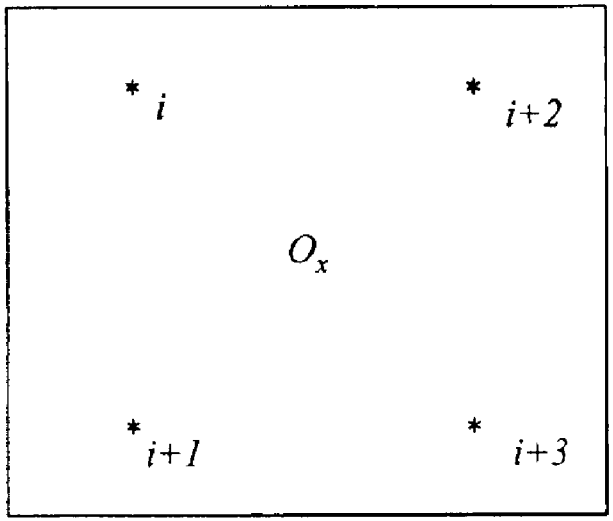
Fig. 5C (PRIOR ART)
FIG. 5C (prior art) shows the 4 codewords of the second stage codebook (see asterisks).

FIG. 5A (prior art) illustrates the result of the combined first and second structured codebooks of a two-stage vector quantizer. The letters a–d symbolize codewords for the first stage codebook, and the numbers 0–15 symbolize codewords for the second stage codebooks. The first stage codewords are evenly distribured to cover the full spectrum of possible frequencies. The codewords for the second stage codebooks are evenly distributed to cover the areas represented by the first stage codewords. The codewords 0–3 cover the region of frequencies corresponding to codeword a. FIGS. 5B and C illustrate individually the structured codebooks of the first and second stage quantizers. FIG. 5B (prior art) shows the 4 codewords of the first stage codebook. FIG. 5C (prior art) shows the 4 codewords of the second stage codebook (see asterisks). Effectively, whatever codeword(s) $O_x$ is selected from the first stage codebook, the second stage codebook $*_i$ through $*_{i+3}$ is applied to each selected $O_x$.

Figure 6:
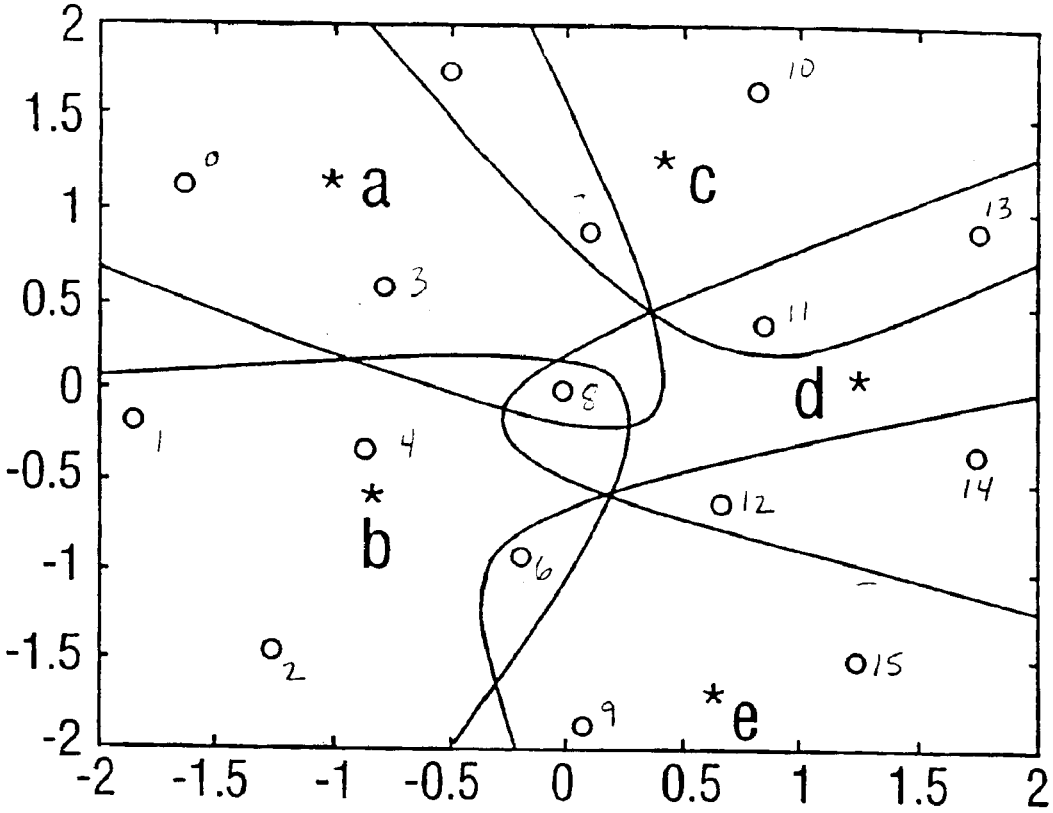
FIG. 6 illustrates the design of a non-structured codebook of a two-stage list quantizer according to one embodiment of the invention.

FIG. 6 illustrates the design of a non-structured codebook of a two-stage list quantizer according to one embodiment of the invention. Consider the case when codebook sizes of both first and second quantizers are equal to 5. The 5 codewords of the first quantizer are labeled by the letters a, b, c, d, and e. The entire 16-word second stage codebook is partitioned into 5 intersecting subsets consisting of 5 points each, as shown in the FIG. 6. In each subset, the 5 points closest to a codeword from first quantizer are included. This partitioning is kept in the reference table memory shown in FIG. 3 and FIG. 4. For the example shown in FIG. 6, this table may be shown in the form shown in Table 1. In Table 1, the codewords are enumerated as shown in FIG. 6. The quantization method uses a first-stage codebook of size $L_1$, a second-stage codebook of size $L_2$, and a list size M as ($L_1$, $L_2$, M)-scheme. The considered example represents (5,5,1)-scheme. The MSE for this scheme and other list quantization schemes for rate 2 dimension 2 case are given in Table 2.

TABLE 1

| 1st codebook word | Second codebook |
|---|---|
| A | 0, 3, 5, 7, 8 |
| B | 1, 2, 4, 6, 8 |
| C | 5, 7, 10, 11, 13 |
| D | 8, 11, 12, 13, 14 |
| E | 6, 9, 12, 14, 15 |

TABLE 2

| Quantization scheme ($L_1$, $L_2$, M) | MSE | Complexity |
|---|---|---|
| (5, 5, 1) | 0.110 | 10 |
| (5, 6, 1) | 0.108 | 11 |
| (5, 7, 1) | 0.105 | 12 |
| (5, 5, 2) | 0.105 | 13.49 |

MSE and Complexity of Some List Quantization Schemes for 16 Codewords 2-Dimensional Quantizers The complexity $\kappa_2$ of the multistage list quantizer shown in FIG. 3 is $$\kappa_2 = L_1 + \left|\bigcup_{i=1}^{M} C_2(j_i)\right| \le L_1 + ML_2, \tag{2}$$

where $L_1$ and $L_2$ are the sizes of first-stage and second-stage codebooks, and M is the number of candidates kept after the first stage, and $C_2(j_i)$ denotes the second-stage codebook corresponding to codeword $j_i$ of the first-stage codebook. The total number of codewords is, in general, less than $L_1L_2$. Note that the value of $\kappa_2$ depends on the list of candidates $(j_1, \ldots, j_M)$ chosen by the first-stage quantizer. It means that the complexity of this scheme is a random variable, but is upper bounded by the right side of inequality (2).

For example, consider a (5,5,2)-scheme. FIG. 6 and Table 1 show that depending on the 2 words chosen by the first-stage quantizer, the second-stage quantizer will search for the best codeword among 8 or 9 candidates. For instance, if first-stage quantizer chose pair {a, b} as a list, then the number of candidates is equal to 9, if the pair {a, c} is chosen, then number of candidates is equal to 8. Taking into account that first stage quantizer computes the error 5 times, the total complexity of (5,5,2)-scheme is estimated as 13.49.

Complexities of different 16-word 2-dimensional quantizers are given in Table 2. Note that (5,7,1) and (5,5,2) methods provide the same quantization quality as a prior art full search quantizer and requires fewer computations. At the same time conventional two-stage M-best quantizers can not provide this quality level irrespectively of the computational complexity. In general, the computational load may be reduced 4–5 times for 4–5 dimensional codebooks of size equal or greater than 512 codewords.

The MSLQ, in a two-stage embodiment, may use two codebooks: RQC (rough quantization codebook) and FQC (fine quantization codebook). Also, the MSLQ can store the reference table information describing each RQC entry, the indices of some predetermined number FQC entries surrounding the RQC vector. MSLQ 300 can implement the following steps. Use an RQC for input vector quantization, and select a predetermined number of candidates. Then, construct a second-stage codebook. This subbook is union of FQC subsets corresponding to selected candidates in reference table. Among the second-stage codebook entries, choose the one closest to input vector in the sense of predetermined distortion measure. Use it's FQC index as a codeword.

This method may be used for more than two quantization stages. For this purpose the sequence of codebooks of increasing size have to be constructed. For each of the previous-stage codewords, the predetermined number indices of the next-stage codewords surrounding that previous-stage codeword are kept in the reference table. Quantization starts with list quantization using the smallest codebook. Then using reference table(s) the second stage codebook is constructed as a union of the sets corresponding to the candidates chosen on the first stage, etc. The final quantization result is one of largest codebook entries. Its index is a codeword corresponding to current LSF vector.

Figure 7:
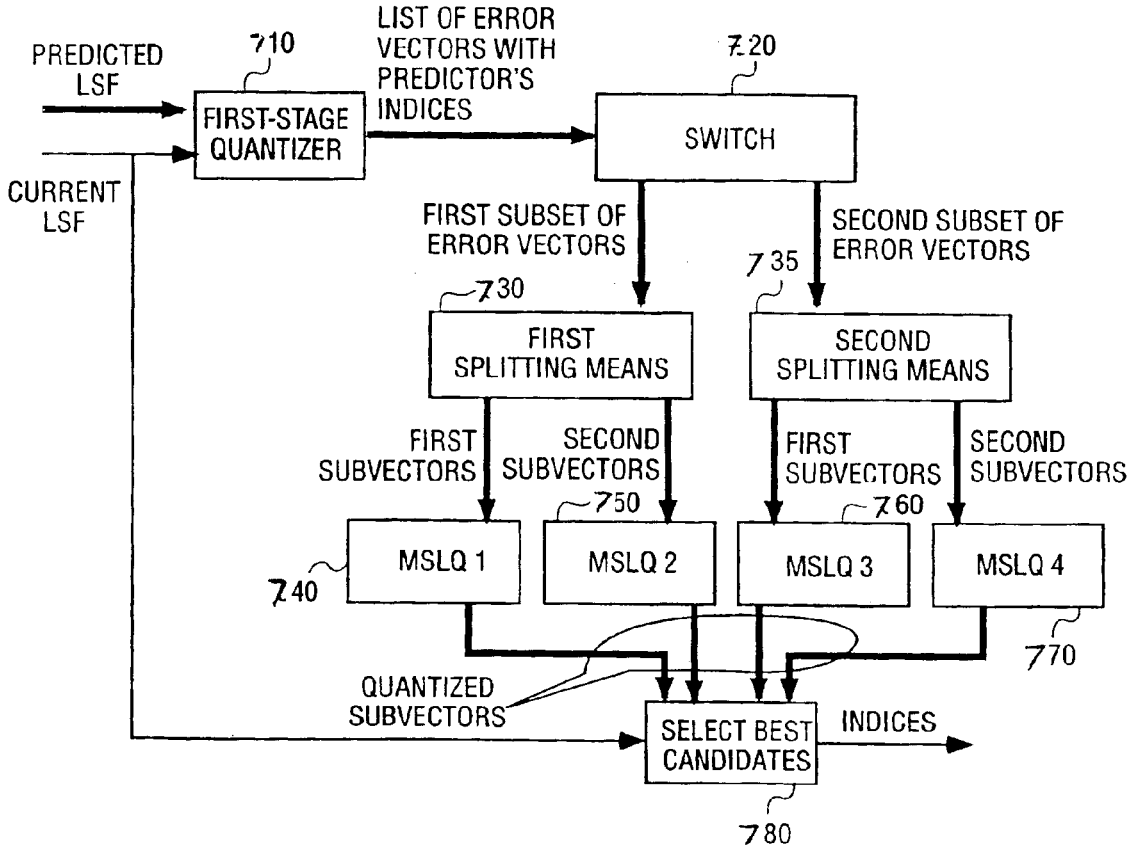
FIG. 7 is a block diagram of a general LSF encoder based on a multistage list quantizer (MSLQ) according to one embodiment of the invention.

An alternative embodiment of vector quantization utilizing MSLQ shown in FIG. 3 is shown in FIG. 7. A set of predicted LSF vectors (e.g., one or more vectors reconstructed from previous quantized LSF vectors) enter the first-stage quantizer unit 710 to be used as part of a codebook that includes a set of standard LSF vectors. In addition, the current LSF vector enters the first-stage quantizer unit 710. The first-stage quantizer 710 selects a predetermined number of candidates from the codebook that provide the best approximation of current LSF vector in the sense of some distortion measure. The output of first-stage quantizer 710 is the list of indices of the chosen candidates with corresponding prediction error vectors. The list of indices and error vectors enter switch unit 720. The switch 720 forwards each error vector to either the first splitting means 730 or to the second splitting means 740 depending on the corresponding candidate index. For example, the error vector for the predicted LSF may be forwarded to first splitting means 730, and the error vector for the standard LSF vectors may be forwarded to second splitting means 735.

Further processing of error vectors is performed by two independent branches. These branches differ one from another in parameters of splitting means and codebooks used for subvectors quantization. It is clear that generally speaking any number of processing branches may be used in another embodiment of the present invention. Those vectors that enter first splitting means 730 are split into a predetermined number of subvectors of smaller dimension. In this embodiment the input vectors are split into 2 subvectors each. Then each subvector is quantized by a corresponding MSLQ unit 740, 750. A similar processing occurs in second splitting means 735 and MSLQ units 760 and 770. Each of the MSLQ units may have its own set of codebooks different from codebook used by other MSLQ units. The outputs of the MSLQ units are sets of quantized subvectors along with corresponding codebook indices. This information enters the select best candidate unit 780, where a final decision about the best candidate is made. The output of quantizer contains the index of the best candidate and indices of 4 codebooks calculated in MSLQ units 740, 750, 760, 770.

The split-vector modification of the MSLQ of FIG. 3 used by the apparatus of FIG. 7 is referred to herein as split multistage list quantization (SMSLQ). In one embodiment, the SMSLQ-based method for quantizing a sequence of LSF vectors consists of the following steps: calculate an LSF vector for the current frame and calculate a set of predicted LSF vectors; calculate distance measure between the current LSF and codewords in a codebook including the set of predicted LSF vectors and a set of standard LSF vectors, select a predetermined number of candidates from the codebook having a minimal distortion measure; send the error vectors for the candidates for SMSLQ; and apply SMSLQ with different codebooks C(j) for quantizing the error vectors e(j), where j denotes the candidate index; select the one of the candidates for which that candidate and its quantized error vector provides the best approximation of the current LSF vector in the sense of a given distortion measure; and construct the fixed length codeword as a concatenation of a variable rate encoded candidate index and the variable rate encoded quantized error vector.

As indicated above, the codebook (or set of candidates) used by the first-stage quantizer 710 includes 2 parts: a standard part and an adaptively varying part. The varying part is represented by the set of predicted LSF vectors. Variable length codewords are assigned to the candidates, because predicted LSF vectors usually are chosen more frequently than the standard LSF vectors. To satisfy this requirement, variable size codebooks are used for the second-stage (SMSLQ) quantization.

The advantage of MSLQ quantization over prior art MSVQ quantization is that MSLQ achieves the same quality as an exhaustive search over the FQC codebook, whereas the set of MSVQ-quantized vectors is direct sum of the stage codebook. The non-structured FQC codebook provides significantly better quantization accuracy than the structured codebooks used in the traditional multistage M-best quantization procedure.

The performance of this embodiment can be compared with the performance of other LSF coding schemes using a weighted Euclidean distance measure which is widely used in speech coding. This weighted distance (WD) d(f,f') between the input vector $f=(f', \ldots, f_p)$ and the quantized vector $f'=(f_1', \ldots, f_p')$ is given by $$d(f, f') = \sum_{j=1}^{P} w_j (f_j - f_j')^2, \tag{3}$$

where p is the number of elements in f, and $w_j$ is a weight assigned to the j th frequency. p=10 in this example. Also, weighting coefficients $w_j$, used in G.723 standard, are applied. This metric weights $w_j$ are given by $$w_1=1/(f_2-f_1),$$

$$w_j-1/\min(f_j-f_{j-1}, f_{j+1}-f_j), j=2 \ldots 9,$$

$$w_{10}=1/(f_{10}-f_9).$$

In one embodiment of the present invention the following parameters of the quantizer of FIG. 7 are chosen. Denote by N the number of codewords in the codebook of the first-stage quantizer 710. In one embodiment, one (first) of these codewords is formed from the previous quantized LSF vector as a predicted LSF vector value, while the rest of the (N−1) codewords do not depend on the previous LSF vectors (e.g., they are precomputed using LBG approach). Alternate embodiments use more predicated LSF vectors.

Figure 8:
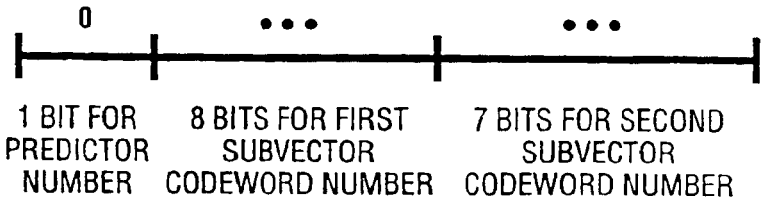
FIG. 8 illustrates the bit allocation of 16 bits per LSF MSLQ-based LSF quantizer according to one embodiment of the invention.
Figure 8:
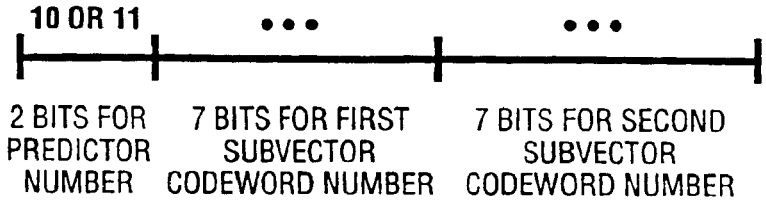

Denote by M the number of candidates chosen by the first-stage quantizer. The switch unit forwards to first splitting means those error vectors which correspond to the predicated LSF vector (if the predicated LSF vector is selected as one of the candidates), and it forwards to second splitting means the remaining error vectors. Both splitting means split input 10-dimensional vectors into pair of 5-dimensional vectors. Denote by $L_1$, $L_2$, $L_3$ and $L_4$ the codebook sizes of codebooks used in MSLQ 1, . . . , MSLQ 4 units. These codebooks are also found using the LBG technique. The parameters of the MSLQ units may be chosen by such a way that quantization precision is the same as for a full-search quantization. To achieve a better number of bits/quantization accuracy tradeoff, a variable-length encoding of candidate indices and different sizes $L_1, \ldots, L_4$ are used. To meet the fixed total number of bits constraint, a larger codebook is used for those candidates for which the candidate's codeword length is shorter. An example of bit allocation is shown on FIG. 8.

The simulation results for different bit rates and bit allocations are shown in Table 3 for fixed rate LSF quantizers with bit rate 15 . . . 22 b/frame. The quantization accuracy is characterized by the average weighted distortion (AWD). The AWD for FS-1016 standard scalar 34 bits/frame quantizer and 24 bits/frame vector-split ITU G.723 standard quantizer are given for the comparison.

TABLE 3

| Quantization scheme | | | | | | | |
|---|---|---|---|---|---|---|---|
| Number of candidates | List size | Book sizes | | | | Number of bits per LSF | Average weighted distance |
| N | M | $L_1$ | $L_2$ | $L_3$ | $L_4$ | vector | (dB) |
| 2 | 2 | 128 | 128 | 128 | 128 | 15 | 6.31 |
| 3 | 3 | 256 | 128 | 128 | 128 | 16 | 5.51 |
| 4 | 4 | 256 | 256 | 128 | 128 | 17 | 4.87 |
| 3 | 3 | 256 | 256 | 256 | 256 | 18 | 4.30 |
| 5 | 4 | 512 | 512 | 256 | 256 | 19 | 3.62 |
| 4 | 4 | 512 | 512 | 512 | 512 | 20 | 3.14 |
| 8 | 4 | 512 | 512 | 512 | 512 | 21 | 2.92 |
| 16 | 4 | 512 | 512 | 512 | 512 | 22 | 2.10 |
| FS-1016 Standard | | | | | | 34 | 5.73 |
| G.723 Standard | | | | | | 24 | 2.90 |

While the invention has been described in terms of several embodiments, those skilled in the art will recognize that the invention is not limited to the embodiments described. The method and apparatus of the invention can be practiced with modification and alteration within the spirit and scope of the appended claims. The description is thus to be regarded as illustrative instead of limiting on the invention.

What is claimed is:

1. An apparatus for audio compression comprising:

a searching unit including a non-structured codebook, said searching unit having an input to receive a source vector and an output to provide a reduced version of a non-structured codebook; and a first quantizer having a first input coupled to receive said source vector and coupled to said output of said searching unit.

2. The apparatus of claim 1 wherein said searching unit comprises:

said non-structured codebook with codewords broken into a plurality of overlapping sets, each of said sets being mapped to a representative codeword, said representative codewords forming a first codebook;

a second quantizer coupled to said first codebook, said second quantizer having an input to receive said source vector and having an output to provide a list identifying a subset of said representative codewords; and a codebook constructor unit coupled to said non-structured codebook and said first quantizer to form said reduced version of said non-structured codebook.

3. An apparatus for audio compression comprising:

a first quantizing unit having an input to receive a source vector and having an output to identify different ones of a plurality of representative codewords based on said source vector;

a storage unit having stored therein a non-structured codebook whose codewords are broken into sets, each set being mapped to a different one of said representative codewords;

a codebook constructor coupled to said first quantizing unit and said storage unit and having an output to provide a reduced version of said non-structured codebook; and a second quantizing unit coupled to said codebook constructor and having an input to receive said source vector.

4. The apparatus of claim 3, wherein said codebook constructor generates said reduced version of said non-structured codebook from the union of the sets corresponding to the currently identified representative codewords.

5. The apparatus of claim 3 wherein said sets overlap.

6. The apparatus of claim 3, wherein said first stage quantizing unit provides at said output a list of indices for the ones of said plurality of representative codewords closest to said source vector.

7. An apparatus for audio compression comprising:

a storage unit having stored therein a set of candidates including a set of standard codewords; and a set of predicted codewords;

a first stage quantizer coupled to said storage unit and having an input to receive a source vector and a new predicted codeword, said first stage quantizer having an output to generate a list of error vectors based on said candidates and said source vector and generate a list of indices of said candidates corresponding to said error vectors;

a logic unit coupled to said first stage quantizer and having an output to transmit a first subset of error vectors including each error vector from said list of error vectors with an index from said list of indices corresponding to one of said predicted codewords, and a second subset of error vectors including each error vector from said list of error vectors with an index from said list of indices corresponding to one of said standard codewords;

a first splitting unit coupled to said logic unit and having an output to generate a plurality of subvectors from said first subset of error vectors;

a second splitting unit coupled to said logic unit and having an output to generate a plurality of subvectors from said second subset of error vectors;

a plurality of multistage vector list quantizers (MSLQ), certain of said plurality of MSLQ coupled to said first splitting unit and certain of said plurality of MSLQ coupled to said second splitting unit, said plurality of MSLQ having output to generate a plurality of quantized subvectors; and a quantizer coupled to said plurality of MSLQ and having an input to receive said source vector and having an output to generate an index from said list of indices of a best candidate and to generate a list of indices for said plurality of quantized subvectors from said plurality of MSLQ.

8. A method of audio compression comprising:

selecting from a non-structured codebook a subset of codewords to form a reduced complexity codebook based on said source vector; and quantizing said source vector with said reduced complexity codebook.

9. The method of claim 8, wherein said selecting includes quantizing said source vector with a first-stage codebook, said first stage codebook having codewords based on said non-structured codebook.

10. The method of claim 8, wherein said selecting comprises:

searching a first stage non-structured codebook for a list of codewords closest to a source vector; and constructing the reduced complexity non-structured codebook based on said list of codewords.

11. The method of claim 10, wherein said constructing comprises:

selecting a different set of codewords from a main non-structured codebook for each codeword identified by said list.

12. A method of audio compression comprising:

searching a first stage non-structured codebook for a predetermined number of codewords based on a source vector;

looking up a plurality of sets of codewords in a table based on the codewords selected as the predetermined number, each set of codewords from said plurality corresponding to a different codeword in said first stage non-structured codebook;

constructing a non-structured codebook from a union of said plurality of sets of codewords; and quantizing said source vector with said non-structured codebook.

13. The method of claim 12 wherein said searching includes selecting as the predetermined number the codewords of said first-stage non-structured codebook that are closest to said source vector.

14. The method of claim 12 wherein said plurality of sets of codewords overlap.

15. The method of claim 12, wherein said quantizing includes selecting the one of said codewords in said non-structured codebook closest to said source vector.

16. A method of audio compression comprising:

selecting from a first stage codebook a list of codewords closest to a source vector, wherein a main non-structured codebook was used to create the non-structured first stage codebook, wherein the first stage codebook has fewer codewords than the main non-structured codebook;

using said list of codewords to select a plurality of sets of codewords from the main codebook;

creating a reduced codebook from the union of said plurality of sets of codewords; and selecting from said reduced codebook a codeword closest to said source vector.

17. The method of claim 16 wherein each of said sets of codewords from the main codebook correspond to a different codeword from said first stage codebook.

18. The method of claim 16 wherein said plurality of sets of codewords overlap.

19. A method of audio compression comprising:

quantizing a source vector with a codebook comprising a set of standard codewords and a set of predicted codewords;

selecting a list of smallest error vectors based on said quantizing and a list of indices for codewords corresponding to the error vectors on said list;

splitting an error vector from said list of smallest error vectors into multiple subvectors with a first splitting unit if said error vector's index from said list of indices corresponds to one of said set of predicted codewords;

splitting an error vector from said list of smallest error vectors into multiple subvectors with a second splitting unit if said error vector's index from said list of indices corresponds to one of said set of standard codewords;

quantizing said multiple subvectors with multiple multistage vector list quantizers into multiple quantized subvectors;

selecting a best candidate based on said multiple quantized subvectors and said source vector; and transmitting an index for said best candidate and indices for said multiple quantized subvectors.

20. The method of claim 19 wherein each of said multiple multistage vector list quantizers utilizes a different codebook.

21. An apparatus for audio compression comprising:

a searching unit including a non-structured codebook, said searching unit having an input to receive a source vector and an output to provide a reduced version of a non-structured codebook, said non-structured codebook with codewords broken into a plurality of overlapping sets, each of said sets being mapped to a representative codeword, said representative codewords forming a first codebook;

a first quantizer having a first input coupled to receive said source vector and a second input coupled to said output of said searching unit, and an output based on said source vector and said reduced version of said non-structured codebook;

a second quantizer coupled to said first codebook, said second quantizer having an input to receive said source vector and having an output to provide a list identifying a subset of said representative codewords; and a codebook constructor unit coupled to said non-structured codebook and said first quantizer to form said reduced version of said non-structured codebook.

22. An apparatus for audio compression comprising:

a first quantizing unit having an input to receive a source vector and having an output to identify different ones of a plurality of representative codewords based on said source vector;

a storage unit having stored therein a non-structured codebook whose codewords are broken into overlapping sets, each set being mapped to a different one of said representative codewords;

a codebook constructor coupled to said first quantizing unit and said storage unit and having an output to provide a reduced version of said non-structured codebook; and a second quantizing unit coupled to said codebook constructor and having an input to receive said source vector and an output based on said reduced version of said non-structured codebook and said source vector.

23. The apparatus of claim 22 wherein said codebook constructor generates said reduced version of said non-structured codebook from the union of the sets corresponding to the currently identified representative codewords.

24. The apparatus of claim 22 wherein said first stage quantizing unit provides at said output a list of indices for the ones of said plurality of representative codewords closest to said source vector.

25. A method of audio compression comprising:

searching a first stage non-structured codebook for a predetermined number of codewords;

looking up a plurality of overlapping sets of codewords in a table based on the codewords selected as the predetermined number, each set of codewords from said plurality corresponding to a different codeword in said first stage non-structured codebook;

constructing a non-structured codebook from a union of said plurality of sets of codewords; and quantizing a source vector with said non-structured codebook.

26. The method of claim 25 wherein said searching includes selecting as the predetermined number the codewords of said first-stage non-structured codebook that are closest to said source vector.

27. The method of claim 25 wherein said quantizing includes selecting the one of said codewords in said non-structured codebook closest to said source vector.

28. A method of audio compression comprising:

selecting from a first stage codebook a list of codewords closest to a source vector, wherein a main non-structured codebook was used to create the non-structured first stage codebook, wherein the first stage codebook has fewer codewords than the main non-structured codebook;

using said list of codewords to select a plurality of overlapping sets of codewords from the main codebook;

creating a reduced codebook from the union of said plurality of sets of codewords; and selecting from said reduced codebook a codeword closest to said source vector.

29. The method of claim 28 wherein each of said sets of codewords from the main codebook correspond to a different codeword from said first stage codebook.

* * * * *